United States Patent [19]

Ro

[11] Patent Number: 5,072,511

[45] Date of Patent: Dec. 17, 1991

[54] NAIL CLIPPER

[76] Inventor: Abraham E. Ro, 45 Deerfield Rd., Whippany, N.J. 07981

[21] Appl. No.: 581,074

[22] Filed: Oct. 5, 1990

Related U.S. Application Data

[63] Continuation of Ser. No. 396,935, Aug. 22, 1989, abandoned.

[51] Int. Cl.[5] ..... A45D 29/00

[52] U.S. Cl. ..... 30/28; 132/75

[58] Field of Search ..... 30/28; 132/73, 75, 75.5

[56] References Cited

U.S. PATENT DOCUMENTS

| | | | |
|---|---|---|---|
| 3,744,131 | 7/1973 | Manes | 30/28 |
| 4,130,937 | 12/1978 | Kim | 30/28 |
| 4,614,031 | 9/1986 | Chen | 30/28 |
| 4,648,415 | 3/1987 | Yuan | 30/28 X |
| 4,731,927 | 3/1988 | Wilson | 30/28 |

*Primary Examiner*—Timothy V. Eley
*Assistant Examiner*—Willmon Fridie, Jr.
*Attorney, Agent, or Firm*—Ribis, Graham & Curtin

[57] ABSTRACT

A nail clipper 10 having a front chamber 16 and a rear chamber 17 for holding nail clippings is provided. The nail clipper includes a container 12 and a resilient plate 13 connected together at one end of the clipper by a rivet 15. The container 12 has an upturned cutting edge 18, and the plate 13 has a downturned cutting edge 19 at the other end of the clipper. A lever 24 has a heel portion and a bent end 25 with a shaft portion 26. A post 27 is mounted on the container and extends through the plate 13 and has groove 28 which receives the shaft portion for operating the plate 13 and causing the cutting edge 18, 19 to coact. The front chamber 16 has a front opening 37 between the cutting edges, when open, for removing clippings from the front chamber 16. The rear chamber 17 has a rear opening 38, when open, for removing clippings from the rear chamber 17.

2 Claims, 2 Drawing Sheets

NAIL CLIPPER

This application is a continuation of application Ser. No. 396,935 filed Aug. 22, 1989, now abandoned.

The invention relates to a nail clipper, and in particular the invention relates to a nail clipper having front and rear clipping storage chambers with front and rear disposal openings.

BACKGROUND OF THE INVENTION

The prior art nail clipper is described in U.S. Pat. No. 3,986,257, issued Oct. 19, 1976. Related patents include U.S. Pat. Nos. 2,515,852 issued July 18, 1950, U.S. Pat. No. 3,031,753, issued May 1, 1962, U.S. Pat. No. 4,017,923, issued Apr. 19, 1977, U.S. Pat. No. 4,150,481, issued Apr. 24, 1979, U.S. Pat. No. 4,196,514, issued Apr. 8, 1980, U.S. Pat. No. 4,380,120, issued Apr. 19, 1983, U.S. Pat. No. 4,640,011, issued Feb. 3, 1987, and U.S. Pat. No. 4,648,415, issued Mar. 10, 1987.

The prior art nail clipper includes a bottom container, a top resilient plate, having connection means at a rear end of the container, the container having an upturned cutting edge at a front end of the container, the plate having a downturned cutting edge opposite to the upturned cutting edge, a lever having a shaft journaled in a post mounted on the container for deflecting the plate, and the container having front and rear clipping storage chambers.

One of the major problems with the prior art nail clipper is that the effort for removal of clippings from the rear storage area is difficult.

SUMMARY OF THE INVENTION

According to the present invention, an improved nail clipper is provided. The nail clipper comprises a bottom container, a top resilient plate having connection means at a rear end to the container, the container having an upturned cutting edge at a front end of the container, the plate having a downturned cutting edge opposite to the upturned cutting edge, a lever having a shaft journaled in a post mounted on the container for deflecting the plate, and the container having front and rear clipping storage chambers, wherein the front chamber has a front clipping disposal opening and the rear chamber has a rear clipping disposal opening.

By using the front and rear clipping disposal openings, the effort for removal of clippings is materially minimized.

The foregoing and other objects, features and advantages of the invention will be apparent from the following detailed description of the preferred embodiment of the invention as illustrated in the accompanying drawings.

Figure 5:
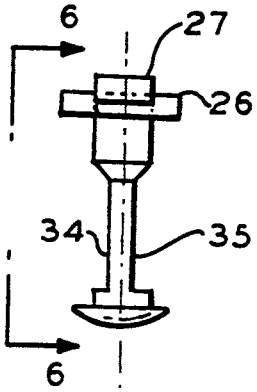
FIG. 5 is a section view as taken along line 5—5 of FIG. 2.
Figure 7:
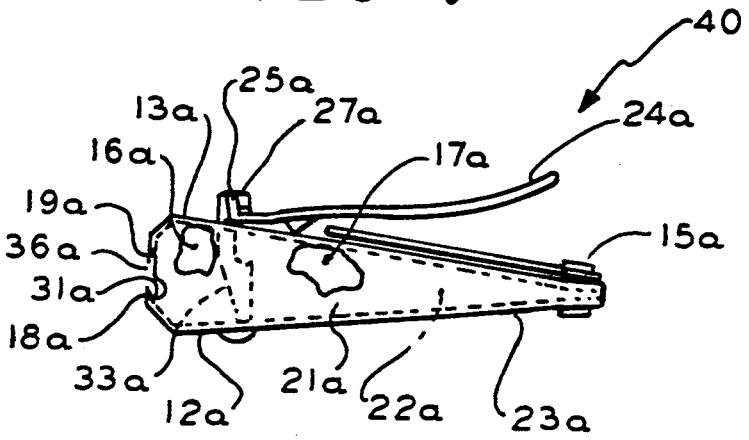
Figure 8:
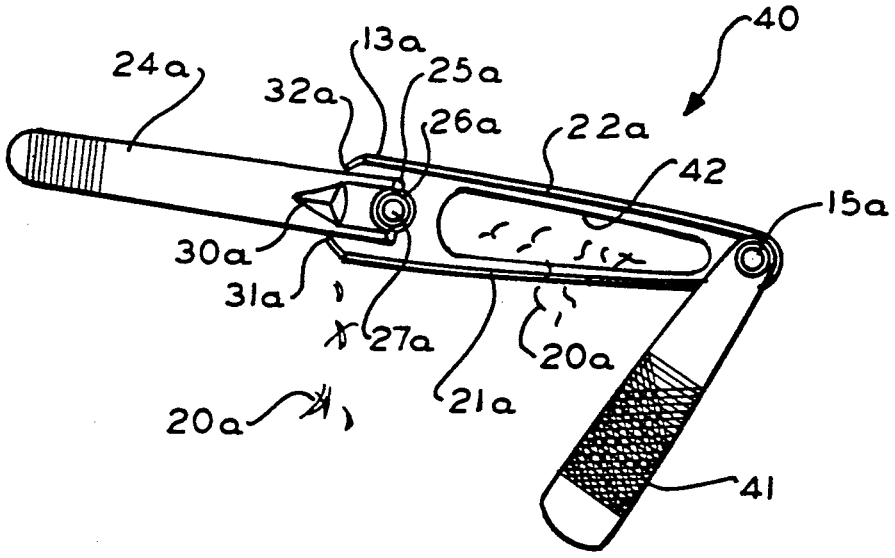

section view as taken along line 6—6 of FIG. 5;

FIG. 7 is an elevation view of a second embodiment of a nail clipper according to the invention; and FIG. 8 is a plan view of the second embodiment of FIG. 7.

DESCRIPTION OF THE PREFERRED EMBODIMENT

As shown in FIGS. 1 through 6, a nail clipper 10 is provided. The clipper 10 has a bottom container 12 and a top resilient plate 13 which are connected at a rear end thereof by a connecting rivet 15 for cutting a nail illustrated at 14;

The container 12 has a front chamber 16 and a rear chamber 17. The container has an upturned cutting edge 18. The resilient plate 13 has a downturned cutting edge 19. Edges 18, 19 coact to cut clippings 20 from the nail 14.

The container 12 has a near side wall 21 and a far side wall 22 and a bottom wall 23, which enclose chambers 16, 17.

The clipper 10 also has a near side wall 21 and a far side wall 22 and a bottom wall 23, which enclose the chambers 16,17.

The clipper 10 also has a lever 24, which has a bent end 25, that has a shaft portion 26, container bottom wall 23 has a post 27, which is fixedly mounted thereon. The post 27 has a cylindrical groove 28, in which shaft portion 26 is journaled. The lever 24 also has a heel portion 30. The post 27 passes through a hole (not shown) in plates 12 and 13.

The near wall 21 has a nail recess 31. The far wall 22 also has a nail recess 32. The post 27 has a deflection surface 33, which deflects a clipping 20 after cutting into chamber 16. The post 27 also has a near side groove 34 and a far side groove 35, in order to permit clipping 20 to pass from the front chamber 16 to the rear chamber 17.

The clipper 10 has a front opening 36 when cutting edges 18, 19 are separated for disposal of clippings 20 from front chamber 16. The clipper 10 also has near and far rear openings 37, 38 for disposal of clippings 20 from rear chamber 17.

Plate 13 overlaps or is within the top edges of walls 21 and 22. In one configuration, the closed position of the clipper 10, there is a very small clearance between the underside of plate 13 and the top surfaces of walls 21 and 22.

Figure 1:
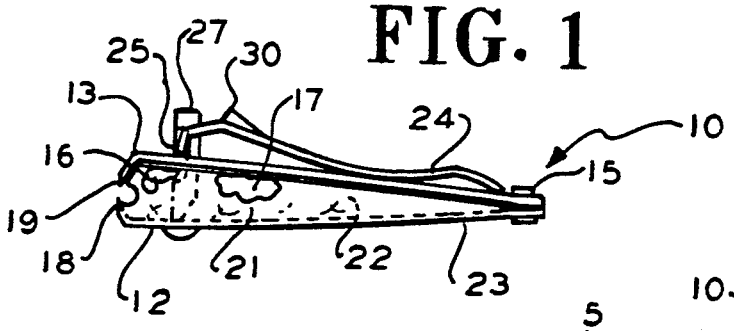
FIG. 1 is an elevation view of a nail clipper according the invention, in a locked closed condition.
Figure 2:
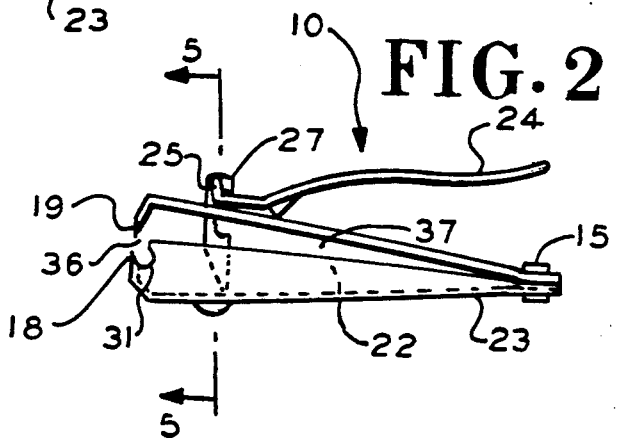
FIG. 2 is an elevation view like the view of FIG. 1 of a nail clipper in an operating position.
Figure 3:
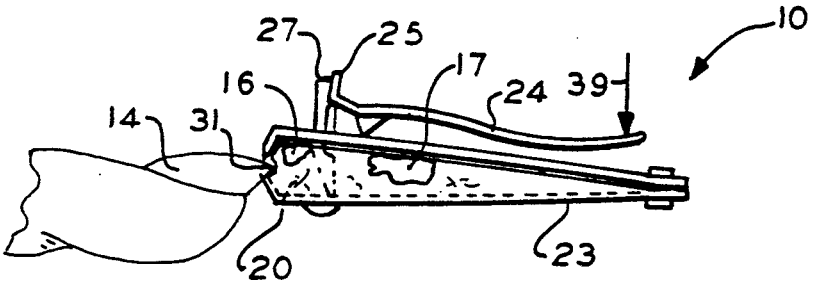
FIG. 3 is an elevation view like the view of FIG. 1 of a nail clipper in a closed operating position.
Figure 4:
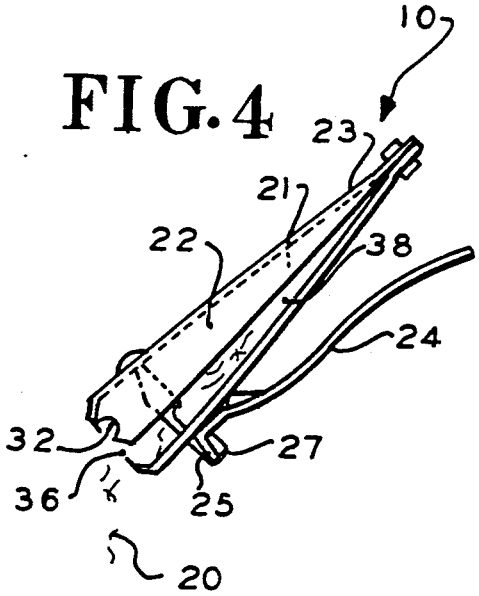
FIG. 4 is an elevation view like the view of FIG. 2 of a nail clipper turned partly on end.
Figure 6:
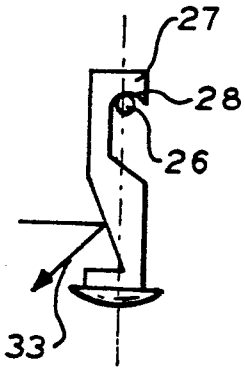

In operation, lever 24, which is in an inoperative or locked position as shown in FIG. 1, is turned 180 degrees to the active position as shown in FIG. 2. The nail 14 is place between the cutting edges 18, 19. The nail 14 may extend into recesses 31,32. A downward force 39 applied to lever 24 causes the cutting edges 18, 19 to cut the nail 14; and the clipping 20 therefrom falls into front chamber 16 or follows a path of travel 40 as shown in FIG. 6, hitting surface 33 and then falling into front chamber 16. Clippings 20 can pass into rear chamber 17 from front chamber 16 of the clipper 10 is tilted toward the rear chamber 17. As shown in FIG. 4, clippings 20 are removed by gravity from front chamber 16 through front U-shaped opening 36 and from rear chamber 17 through rear and far rear openings 37, 38, after the clipper 10 is placed in an open operative position by releasing force 30 and by tilting or shaking the clipper 10. Clippings 20 can be removed right after cutting, or can be stored for later removal.

As shown in FIGS. 7 and 8, a second embodiment of the clipper 40 is provided. The clipper 40 has a bottom container 12*a* and a top resilient plate 13*a* which are connected by rivet 15*a*. The clipper 40 has a front chamber 16*a* and a rear chamber 17*a*. Container 12*a* has a cutting edge 18*a*, and plate 13*a* has a cutting edge 19*a*, opposite to edge 18*a*. Clippings 20 collect in chambers 16*a*, 17*a*.

Container 12*a* has a rear side wall 21*a* and a far side wall 22*a* and a bottom wall 23*a*.

Clipper 40 has a lever 24*a*, which has a bent end 25*a* with a shaft portion 26*a*. The clipper 40 has a post 27*a*, which has a cylindrical groove portion ( not shown) that receiver shaft 26*a*. Lever 24*a* has a heel portion 30*a*.

Walls 21*a*, 22*a* have respective nail recesses 31*a*, 32*a* respectively disposed on the sides of cutting edge 18*a*.

When the clipper 40 is in an open operative position as shown in FIG. 7, the clipper 40 has a front opening 36*a* for removal of clippings 20 from front chamber 16*a*. Plate 13*a* has a swingable nail file 41 which can cover a rear opening 42. When opening 42 is uncovered, clippings 20 can be removed from rear chamber by turning sidewards and shaking the clipper 40 as shown in FIG. 8.

The advantages of the clipper 10 and the clipper 40 are indicated hereafter.

A. The clipper 10 and 40 collects all clippings 20 during cutting of the nail 14 without any additional operative steps by a user.

B. The clipper 10 and 40 has a relatively low cost of manufacture as compared to a prior art clipper.

C. Rear chamber 17 provides extra storage space as compared to the storage space of a prior art clipper.

D. Bent end 25 helps to contain clippings 20 in both chambers 16 and 17 during carrying or transportation of the clippers.

E. Clipping can be easily removed from the clipper 10 through front opening 36 and rear openings 37, 38, and from the clipper 40 through front opening 36*a* and rear opening 42.

F. Clippings 20 have pass through enlarged passages formed by grooves 34, 35 from front chamber 16 to rear chamber 17.

G. The clipper 10, 40 facilitates the removal of clippings 20 from rear chamber 17 as compared to the prior art clipper.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. A nail clipper comprising:

a bottom container; a top resilient plate; connection means connecting adjacent ends of the container and the plate; said container having an upturned cutting edge at another end thereof; said plate having a downturned cutting edge disposed oppositely to the upturned cutting edge; a lever having a bent end portion with a shaft portion and having a heel portion; a post mounted on the container and having a post groove receiving the shaft portion, said post passing through a hole in the plate; said container having a near side wall and a far side wall and a bottom, together with the plate, forming a front chamber and a rear chamber; said front chamber having a front opening; and said plate having a top face with a door opening; said plate having a nail file connected at one end thereof to a rivet; said nail file having a bottom face in sliding engagement with the top face, the post has a necked down portion with grooves disposed between the plate and the bottom wall of the container thereby narrowing the post in a direction parallel to the downturned cutting edge, said necked-down portion grooves forming sides of respective passages disposed on either side of the post for ease of entry of a nail clipping to the rear chamber, said necked-down portion has a deflection surface substantially forming an elliptical cylinder section with an ellipse section surface running with a vertice of a major axis of the ellipse disposed on the post near the cylindrical groove and a substantially rectangular section adjoining the elliptical section, said rectangular section having two opposite sides defined by the necked down portion grooves of the post and said deflection surface facing said rear chamber, said deflection surface facing said rear chamber, said deflection surface being disposed at an angle to the bottom wall of the container for downwardly deflecting a nail clipping into the rear chamber which is rebounding from the rear chamber.

2. A nail clipper comprising:

a bottom container; a top resilient plate; connection means connecting adjacent ends of the container and the plate; said container having an upturned cutting edge at another end thereof; said plate having a downturned cutting edge disposed oppositely to the upturned cutting edge; a lever having a bent end portion with a shaft portion and having a heel portion; a post mounted on the container and having a post groove receiving the shaft portion, said post passing through a hole in the plate; said container having a near side wall and a farside wall and a bottom, together with the plate, forming a front chamber and a rear chamber; said front chamber having a front opening; and said plate having a top face with a door opening; said plate having a nail file connected at one end thereof to a rivet; said nail file having a bottom face in sliding engagement with the top face; wherein the post has a necked down portion with grooves disposed between the plate and the bottom wall of the container thereby narrowing the post in a direction parallel to the downturned cutting edge, said necked-down portion grooves forming sides of respective passages disposed on either side of the post for ease of entry of a nail clipping to the rear chamber; wherein said necked-down portion has a deflection surface substantially forming an elliptical cylinder section with an ellipse section surface running with a vertice of a major axis of the ellipse disposed on the post near the cylindrical groove and substantially rectangular section adjoining the elliptical section, said rectangular section having two opposite sides defined by the necked down portion grooves of the post and said deflection surface facing said rear chamber, said deflection surface being disposed at an angle to the bottom wall of the container for downwardly deflecting a nail clipping into the rear chamber which is rebounding from the rear chamber; wherein the lever bent end portion shaft portion has a cylindrical bearing surface; wherein the post groove has a cylindrical bearing surface extending through the post with the corresponding cylinder axis disposed about parallel to the down-turned cutting edge and which cylindrical bearing surface receives the lever bent end portion shaft portion; wherein the lever bent end portion heal portion is a formed plat portion with the bent end portion directed away from the plate; and wherein the lever bent end portion heel portion and the remainder of the lever have substantially the same thickness.

* * * * *